United States Patent [19]

Lawrence et al.

[11] Patent Number: 4,503,939

[45] Date of Patent: Mar. 12, 1985

[54] ELEVATOR SYSTEM

[75] Inventors: Fitzroy L. Lawrence, East Orange; Pantelis G. Tinios, Mt. Arlington, both of N.J.

[73] Assignee: Westinghouse Electric Corp., Pittsburgh, Pa.

[21] Appl. No.: 524,811

[22] Filed: Aug. 19, 1983

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,379,285 | 4/1968 | Leitz | 187/29 |
| 3,474,886 | 10/1969 | Iordanidis | 187/29 |
| 3,779,346 | 12/1973 | Winkler | 187/29 |
| 3,814,216 | 6/1974 | Pisatowski | 187/29 |
| 4,067,416 | 1/1978 | Lowry | 187/29 |
| 4,085,823 | 4/1978 | Caputo et al. | 187/29 |
| 4,128,141 | 12/1978 | Caputo et al. | 187/29 |
| 4,161,236 | 7/1979 | Husson | 187/29 |
| 4,225,015 | 9/1980 | Yamada | 187/29 |
| 4,238,005 | 12/1980 | Watanabe et al. | 187/29 |
| 4,318,456 | 3/1982 | Lowry | 187/29 |
| 4,356,896 | 11/1982 | Tamura et al. | 187/29 |
| 4,456,096 | 6/1984 | Kajiyama | 187/29 |

*Primary Examiner*—J. V. Truhe
*Assistant Examiner*—W. E. Duncanson, Jr.
*Attorney, Agent, or Firm*—D. R. Lackey

[57] ABSTRACT

A speed switch for an elevator system which obtains its information from distance pulses generated in response to car travel. The reference speed setting of the switch is a function of the desired predetermined speed at which the switch is to operate, the number of distance pulses produced per inch of car travel, and the time required by a counter to count to a predetermined value. This arrangement facilitates the selection of the reference speed setting of the speed switch, such as by using a thumb switch. An emergency terminal stopping arrangement using the speed switch is also disclosed, as is a new and improved elevator system in which the normal slow-down speed pattern and emergency terminal stop functions are both resposive to distance pulses produced in response to car movement, enabling a terminal slow-down speed pattern to be initiated by circuitry independent of the distance pulses, such as via a notched terminal slow-down blade adjacent to each terminal floor.

11 Claims, 5 Drawing Figures

| | ADDRESS | | | | | | | | | | | | ROM (64) MAP | | | | | | | |
|---|---|---|---|---|---|---|---|---|---|---|---|---|---|---|---|---|---|---|---|---|
| | 1 | 1 | 1 | 1 | 1 | 1 | 1 | 1 | 1 | 1 | 1 | 1 | 0 | 0 | 0 | 0 | 0 | 0 | 0 | 0 |
| | 0 | 1 | 1 | 1 | 1 | 1 | 1 | 1 | 1 | 1 | 1 | 1 | 0 | 0 | 0 | 0 | 0 | 0 | 0 | 0 |
| | 1 | 0 | 1 | 1 | 1 | 0 | 1 | 1 | 1 | 0 | 0 | 1 | 0 | 0 | 0 | 0 | 0 | 0 | 0 | 0 |
| C → | 1 | 0 | 1 | 1 | 1 | 0 | 1 | 1 | 1 | 0 | 0 | 0 | 0 | 0 | 0 | 0 | 0 | 0 | 0 | 0 |
| | 1 | 0 | 1 | 1 | 1 | 0 | 1 | 1 | 0 | 1 | 1 | 1 | 1 | 1 | 1 | 1 | 1 | 1 | 1 | 1 |
| | 0 | 0 | 0 | 0 | 0 | 0 | 0 | 0 | 0 | 0 | 0 | 1 | 1 | 1 | 1 | 1 | 1 | 1 | 1 | 1 |
| | 0 | 0 | 0 | 0 | 0 | 0 | 0 | 0 | 0 | 0 | 0 | 0 | 1 | 1 | 1 | 1 | 1 | 1 | 1 | 1 |

ELEVATOR SYSTEM

BACKGROUND OF THE INVENTION

1. Field of the Invention

The invention relates in general to elevator systems, and more specifically to elevator systems which generate distance pulses in response to movement of the elevator car.

2. Description of the Prior Art

An elevator system requires a normal terminal stopping arrangement which, independently of the normal slowdown and stopping arrangement, will automatically reduce the speed of the elevator car as it approaches a terminal landing, and stop it at the terminal floor. The independent terminal slowdown function will hereinafter be referred to as TSD, for "Terminal Slow Down". Also, some additional emergency terminal device must be used. For example, with reduced stroke buffers, an emergency terminal speed limiting device must be used which is completely independent of any other emergency-related device. This same terminal speed limiting device may also be used in elevator systems which have normal stroke buffers. This device will hereinafter be referred to as ETS for "Emergency Terminal Stop".

With solid state elevator control systems, it is convenient to keep track of car position by generating a distance pulse for each predetermined standard increment of car movement, such as a distance pulse for each 0.25 inch of car travel, and to increment or decrement a car position counter according to travel direction. The distance pulses may also be used in the generation of the normal slowdown and stopping speed pattern. The normal slowdown and stopping arrangement will be referred to as SLDN.

One prior art arrangement for providing ETS utilizes hatch switches and speed switches in the form of mercury switches located on the governor. The mercury switches have the disadvantage of a substantial tolerance in the speed setting.

In distance pulse speed pattern systems, it is not permissible to develop TSD from the distance pulses, as TSD must be completely independent of SLDN. The distance pulses may be used in the ETS function, however, as long as they are not used in any other emergency related device. Thus, it would be desirable to provide a new and improved ETS arrangement utilizing the distance pulses.

SUMMARY OF THE INVENTION

Briefly, the present invention is a new and improved solid state speed switch which utilizes distance pulses, and a new and improved elevator system which utilizes the new solid state speed switch in an ETS arrangement. The solid state speed switch will operate at the selected car speed with less than one FPM resolution. This accuracy is achieved by generating a fixed frequency at a rate which is much greater than the maximum rate at which the distance pulses will be generated. The number of such high frequency pulses produced while a predetermined number of distance pulses are produced, provides the desired indication of car speed. This is much more accurate than a system which would count the number of distance pulses produced in a predetermined period of time, as the maximum error is only one high frequency pulse, not one distance pulse.

While the count of high frequency pulses could be used to address a read-only memory (ROM) programmed for a specific speed value, the custom programming would add substantially to the cost as a large number of such ROMs would have to be stocked. Each ETS system may have several speed check points, and their values would be different for each rated or contract speed of the elevator car. The programmed speed would have to be carefully stamped on each ROM, to prevent confusion, and extreme care would have to be taken to match the correct ROMs with each job.

The present invention utilizes a ROM in each speed switch, but it overcomes the above-mentioned problems by an arrangement which enables every ROM to be programmed precisely the same, regardless of the speed setting of the associated speed switch. The disclosed speed switch arrangement also enables each speed switch to be manually set to the desired speed, such as with a thumb DIP switch. Thus, all speed switches are manufactured exactly the same, and the speed switches manually programmed to the specified speeds for the particular job they are used on.

In a preferred embodiment of the invention, an elevator system is disclosed which utilizes distance pulses in SLDN and ETS, and a notched blade in the hatch adjacent to each terminal floor which is detected by a pick-up on the elevator car to produce an auxiliary speed pattern for the TSD function.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
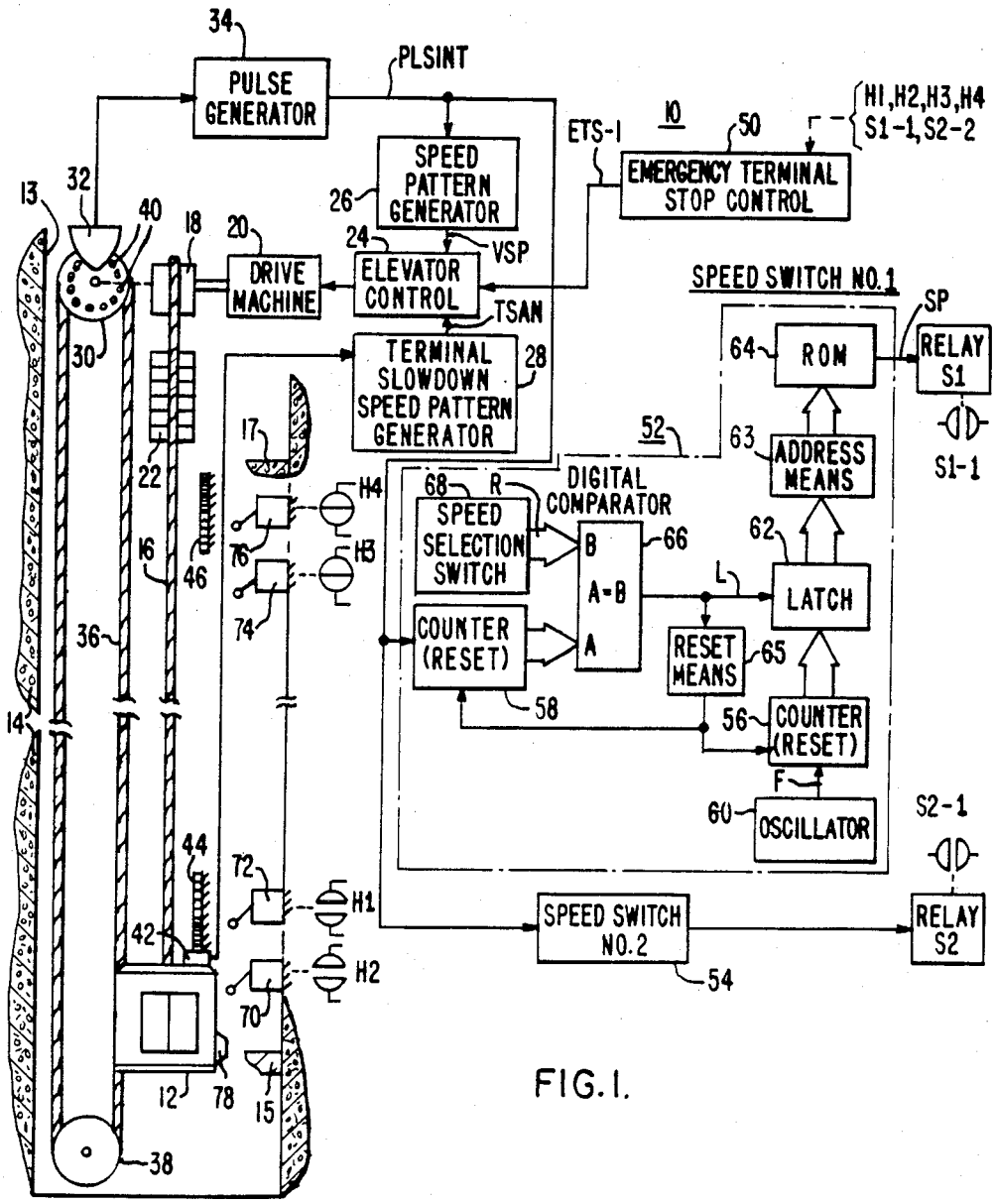
FIG. 1 is a partially block and partially schematic diagram of an elevator system constructed according to the teachings of the invention.

Referring now to the drawings, and to FIG. 1 in particular, there is shown an elevator system 10 constructed according to the teachings of the invention. Elevator system 10 includes an elevator car 12 mounted in a hoistway or hatchway 13 for movement relative to a structure or building 14 having a plurality of floors or landings. Only the lower and upper terminal floors 15 and 17, respectively, are shown in order to simplify the drawing. Car 12 is supported by wire ropes 16 which are reeved over a traction sheave 18 mounted on the shaft of a drive machine 20, such as a drive machine which has an AC or DC motor. A counterweight 22 is connected to the other ends of the ropes 16.

The control for operating the drive machine 20 is shown generally at 24, 26 and 28. U.S. Pat. No. 4,030,570 discloses closed loop car speed control, U.S.

Pat. No. 4,277,825 discloses drive machine control, and U.S. Pat. No. 3,750,850 discloses a car controller, which may be used for control 24. U.S. Pat. No. 3,750,850 and co-pending application Ser. No. 446,149 filed Dec. 2, 1982, entitled "Speed Pattern Generator for an Elevator Car", disclose speed pattern generators which generate a normal slowdown and stopping pattern VSP, and they may be used for the speed pattern generator function 26. U.S. Pat. No. 3,779,346 discloses control which may be used for the TSD function 28. These patents and patent application, all of which are assigned to the same assignee as the present application, are hereby incorporated into the specification of the present application by reference.

Distance pulses PLSINT are provided in response to car movement, such as by distance pulse means which includes a pulse wheel 30, a pick-up 32 and a pulse generator 34. Pulse wheel 30 may be part of, or driven in synchronism with, the governor sheave, which is driven by a wire rope 36. The wire rope 36 loops about a sheave 38 in the pit, and it is also connected to the elevator car 12. Openings 40 in the pulse wheel 30 are detected by the pick-up 32, with the pick-up 32 being of any suitable type, such as optical or magnetic. The openings 40 in the pulse wheel 30 are spaced to provide a distance pulse PLSINT for each predetermined standard increment of car travel, such as a pulse for each 0.25 inch of car movement. The SLDN portion of the speed pattern provided by the speed pattern generator 26 is responsive to the distance pulses PLSINT, with the distance pulses being used to determine the distance-to-go from the elevator car to the target floor.

As disclosed in the hereinbefore-mentioned U.S. Pat. No. 3,779,346, a redundant and independent terminal slowdown control is provided by a combination of pick-up means and spaced marker means. Pick-up means 42 is mounted on the elevator car, and the spaced marker means is in the form of elongated plates or blades 44 and 46 disposed adjacent to the lower and upper terminal floors 15 and 17, respectively. The blades 44 and 46, in order to function as spaced markers, are provided with notches, holes or openings. The notches or openings are spaced and oriented such that the pick-up means 42 on the car 12 can detect their presence as the car approaches a terminal floor and initiate pulses which are utilized by terminal slowdown control 28 shown in the incorporated U.S. Pat. No. 3,779,346. The openings in each slowdown blade are spaced such that if the car is slowing down with a constant rate of deceleration, the time elapsed as the car travels from one opening to the next stays constant. If the car is not decelerating, or the deceleration rate of the car is not within acceptable limits, the time between the spaced openings will be shorter than normal and the monitoring circuit in the terminal slowdown control 28 will detect this overspeed condition and cause the car to initiate TSD. The same blade used to detect overspeed is also used to generate an auxiliary speed pattern TSAN when an overspeed condition is detected.

Figures 2, 3:
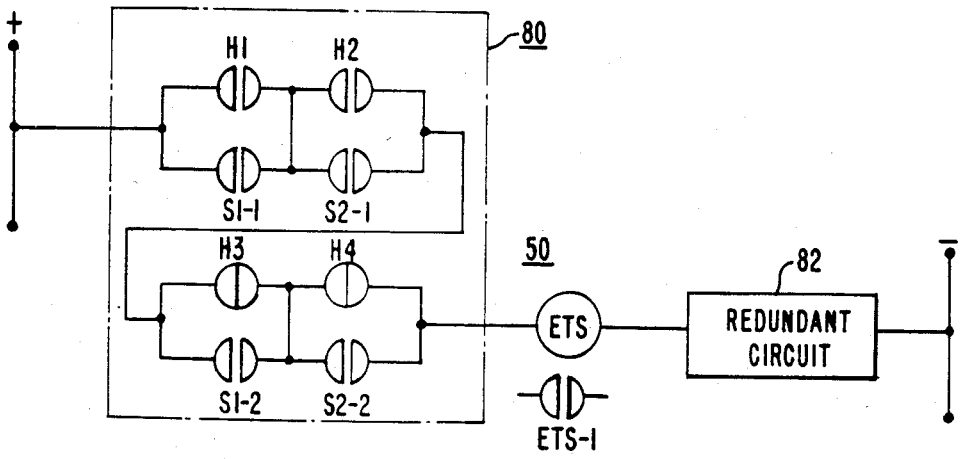
FIG. 2 is a ROM map illustrating an exemplary program for the read-only memory (ROM) shown in FIG. 1.
FIG. 3 is a schematic diagram of a circuit which utilizes the speed switch shown in FIG. 1 in a protective ETS arrangement.

The emergency terminal stop or ETS control is shown generally at 50, and in detail in FIG. 3. The speed points required by the ETS function are provided by solid state speed switches constructed according to the teachings of the invention, with a separate speed switch being utilized for each different desired speed point. For purposes of example, first and second speed switches 52 and 54 are illustrated, but any number may be used. Since each speed switch is of identical construction, as will be hereinafter explained, only speed switch 52 is shown in detail.

More specifically, solid state speed switch 52 provides an output SP which has a logic level indicative of whether the speed of the elevator car is above or below the selected speed. For example, if the car speed is at or below the selected speed, signal SP may be at the logic zero level, and if it exceeds the selected speed, it may be at the logic one level.

In order to cause speed switch 52 to change its output within a resolution of 1 FPM from the selected speed, the speed switch 52 utilizes first and second counters 56 and 58, respectively. The first counter 56 is arranged to count the fixed frequency F of a crystal controlled oscillator 60. The frequency F is selected to greatly exceed the maximum rate of the distance pulses, such as about 100 times greater. For purposes of example, it will be assumed that F is 30 KHz. The second counter 58 is arranged to count the distance pulses PLSINT.

The output of counter 56 is applied to the input of a latch 62, and the latch input is transferred to the latch output on the rising edge of a clock or latch signal L. The latched count is used to address a non-volatile read-only memory (ROM) 64 via address means 65, and ROM 64 provides the output signal SP.

An arbitrary clock period T for comparison with signal L is selected, such as 100 ms. By definition, if the period of signal L is equal to, or greater than, 100 ms, the speed of the elevator car 12 is at or below the selected speed V for the speed switch, and if the period of signal L is less than 100 ms, the speed of the car is greater than V.

Counter 56 will count to 3,000 in 100 ms if F is 30 KHz. Thus, ROM 64 is programmed as shown in the ROM map of FIG. 2, to output a logic zero when addressed by a binary count equivalent to decimal 3000 and above, and to output a logic one when addressed by binary count equal to or less than decimal 3000. Count 3000 is referenced C in FIG. 2.

Signal L is provided by a digital comparator 66. Comparator 66 provides a signal L which changes from a logic zero to a logic one each time its two digital inputs A and B are equal to one another. The output of counter 58 is applied to one of the digital inputs, such as input A, and an adjustable reference count R is applied to the other input, such as via a speed selection switch 68. In a preferred embodiment of the invention, switch 68 is a thumb DIP switch. Thus, each time the count of counter 58 reaches the reference count R, comparator 66 outputs a true signal L and the count on counter 56 is applied to ROM 64 via latch 62.

Signal L is applied to reset means 65, such as a delay circuit, and the output signal from the reset means is used to reset both of the counters 56 and 58.

The reference count R is a function of the desired speed switch setting V, the number P of distance pulses produced per inch of car travel, and the time T for the counter to count to C (3000). This relationship is set forth in the following equation:

$$R = VPT \tag{1}$$

where:

R = Reference Count

V = Desired Speed Switch Setting in Inches Per Second

P = Distance Pulses Per Inch of Car Travel

T = Time in Seconds for Counter 56 to Count to C

For example, if it is desired to set speed switch 82 to a V of 1,000 FPM, P is equal to four distance pulses per inch of car travel, and the time T for counter 56 to count to C (3000) is 0.1 second, the reference count R would be:

$$R = \frac{1000 \times 12}{60} \times 4 \times .1 \quad (2)$$

$$R = 80 \quad (3)$$

Thus, R would be set to the equivalent value of decimal 80. If the car speed is greater than 1000 FPM, counter 58 will reach the binary equivalent of decimal 80 is less than 0.1 second. The count on counter 56 when it is latched by signal L will be less than the binary equivalent of decimal 3000, and ROM 64 will output signal SP at the logic one level. This indicates that the car speed exceeds the reference setting of the speed switch. If the car speed is 1000 FPM, or less, counter 58 will reach the binary equivalent of decimal 80 in 0.1 second, or more, and the count on counter 56 when signal L goes true will be at the binary equivalent of decimal 3000, or greater, and ROM 64 will output a logic zero, indicating the car speed is at or below the reference setting of the speed switch.

Table I below sets forth the count C in decimal and binary for car speeds from 100 FPM to 1600 FPM in 100 FPM increments. The reference count R may be easily calculated for any other desired speed point, by using equation (1).

TABLE I

| | COUNT - C | | | | | | | |
|---|---|---|---|---|---|---|---|---|
| FPM | DECIMAL | MSB | BINARY | | | | | LSB |
| 1600 | 128 | 1 | 0 | 0 | 0 | 0 | 0 | 0 |
| 1500 | 120 | 0 | 1 | 1 | 1 | 1 | 0 | 0 |
| 1400 | 112 | 0 | 1 | 1 | 1 | 0 | 0 | 0 |
| 1300 | 104 | 0 | 1 | 1 | 0 | 1 | 0 | 0 |
| 1200 | 96 | 0 | 1 | 1 | 0 | 0 | 0 | 0 |
| 1100 | 88 | 0 | 1 | 0 | 1 | 1 | 0 | 0 |
| 1000 | 80 | 0 | 1 | 0 | 1 | 0 | 0 | 0 |
| 900 | 72 | 0 | 1 | 0 | 0 | 1 | 0 | 0 |
| 800 | 64 | 0 | 1 | 0 | 0 | 0 | 0 | 0 |
| 700 | 56 | 0 | 0 | 1 | 1 | 1 | 0 | 0 |
| 600 | 48 | 0 | 0 | 1 | 1 | 0 | 0 | 0 |
| 500 | 40 | 0 | 0 | 1 | 0 | 1 | 0 | 0 |
| 400 | 32 | 0 | 0 | 1 | 0 | 0 | 0 | 0 |
| 300 | 24 | 0 | 0 | 0 | 1 | 1 | 0 | 0 |
| 200 | 16 | 0 | 0 | 0 | 1 | 0 | 0 | 0 |
| 100 | 8 | 0 | 0 | 0 | 0 | 1 | 0 | 0 |

The output SP of ROM 64 may control a relay S1 having an n.o. contact S1-1. Contact S1-1, as well as a contact S2-1 from a relay S2 responsive to the speed switch 54, are used by the ETS control 50. ETS control 50 additionally includes a hatch switch in each terminal slowdown zone associated with each different speed point. For example, with two speed points provided by speed switches 52 and 54, two hatch switches 70 and 72 having contacts H1 and H2, respectively, would be disposed in the lower terminal slowdown zone, and two hatch switches 74 and 76 having contacts H3 and H4, respectively, would be disposed in the upper terminal slowdown zone. Hatch switches 72 and 74 are associated with speed switch 52, and hatch switches 70 and 76 are associated with speed switch 54. The hatch switches may be actuated by a cam carried by the car 12, or by a cam carried by the counterweight 22. For purposes of example, a cam 78 is shown on car 12, while in practice it would probably be mounted on the counterweight to reduce noise in the car. When the elevator car 12 leaves a terminal floor, cam 78 on the car closes the hatch switches associated with that terminal floor, and when the car approaches a terminal floor, cam 78 sequentially opens the associated hatch switches. The hatch switches are spaced from their associated terminal floor by predetermined different distances, and the speed switch setting, selected by count R, is selected such that the car speed, when the car is slowing down correctly, will be below the speed setting of the speed switch when the associated hatch switch is opened. The contacts of the hatch switches and the contacts of the speed switches are connected as shown within the broken outline 80 in FIG. 3. A relay ETS having an n.o. contact ETS-1 is energized by circuit 80. A redundant circuit 82 may also be connected in the energization circuit of relay ETS, using contacts of the same hatch switches and contacts from different, redundant speed switches. Contact ETS-1 is connected in the circuit of the safety relay, such as the 29 relay shown in U.S. Pat. No. 4,085,823. When the safety or 29 relay drops while the elevator car is running, power is removed from the drive motor, dynamic braking resistors are connected across the armature of the drive motor, and the brake coil is deenergized to drop or set the friction brake located on the drive machine.

It will be noted from FIG. 3 that either the hatch switch contacts or the contacts from the associated speed switch must be closed in order to maintain relay ETS energized. As long as the car speed is below the speed switch setting when the car opens the associated hatch switch, relay ETS will remain energized. If the car speed is above the speed setting of a speed switch when the elevator car passes and opens the associated hatch switch, relay ETS will drop out, its contact ETS-1 will open, and the 29 relay will drop out to initiate an emergency stop of the elevator car.

Figure 4:
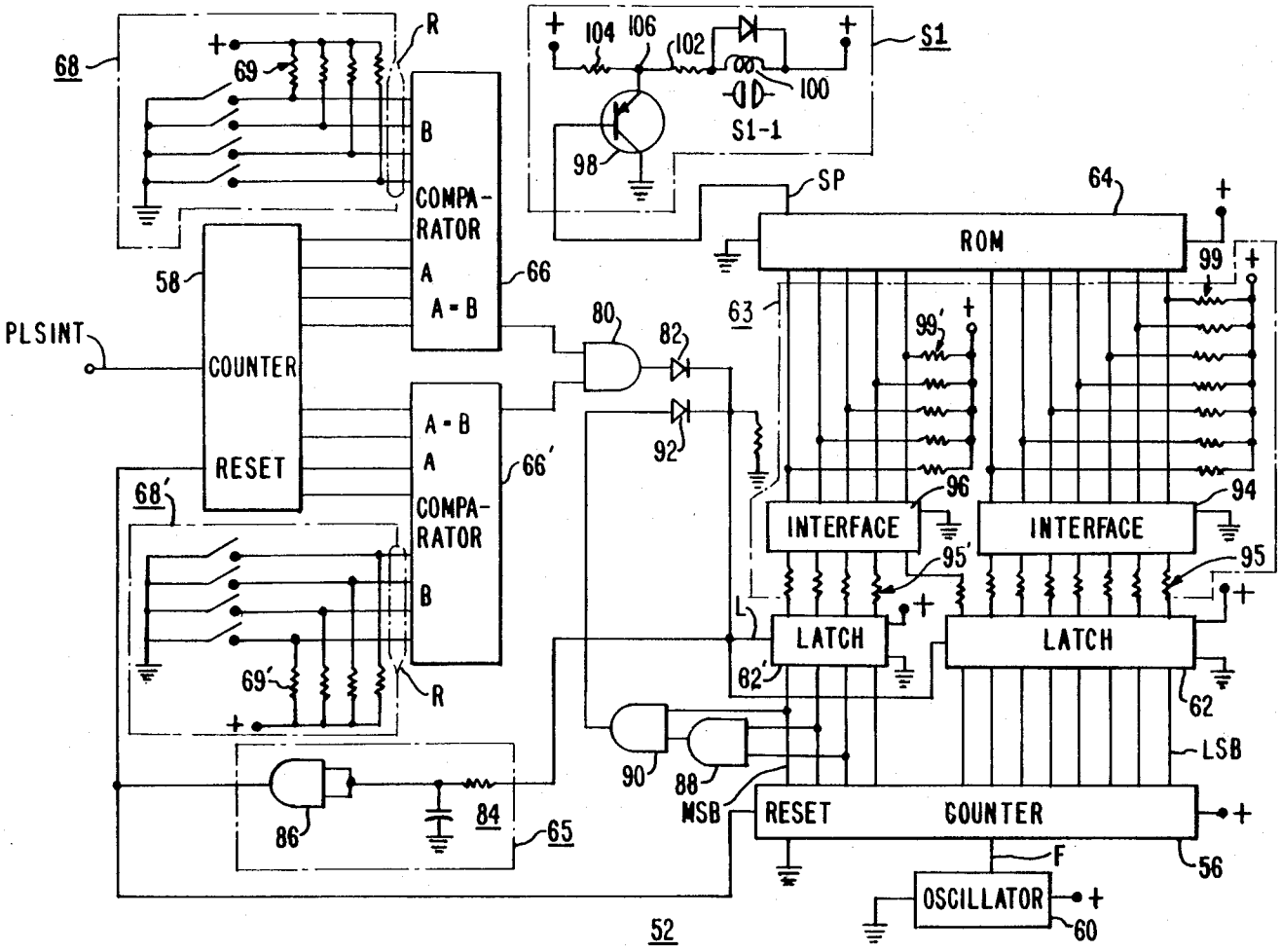
FIG. 4 is a detailed schematic diagram of the solid state speed switch shown in FIG. 1.
Figure 5:
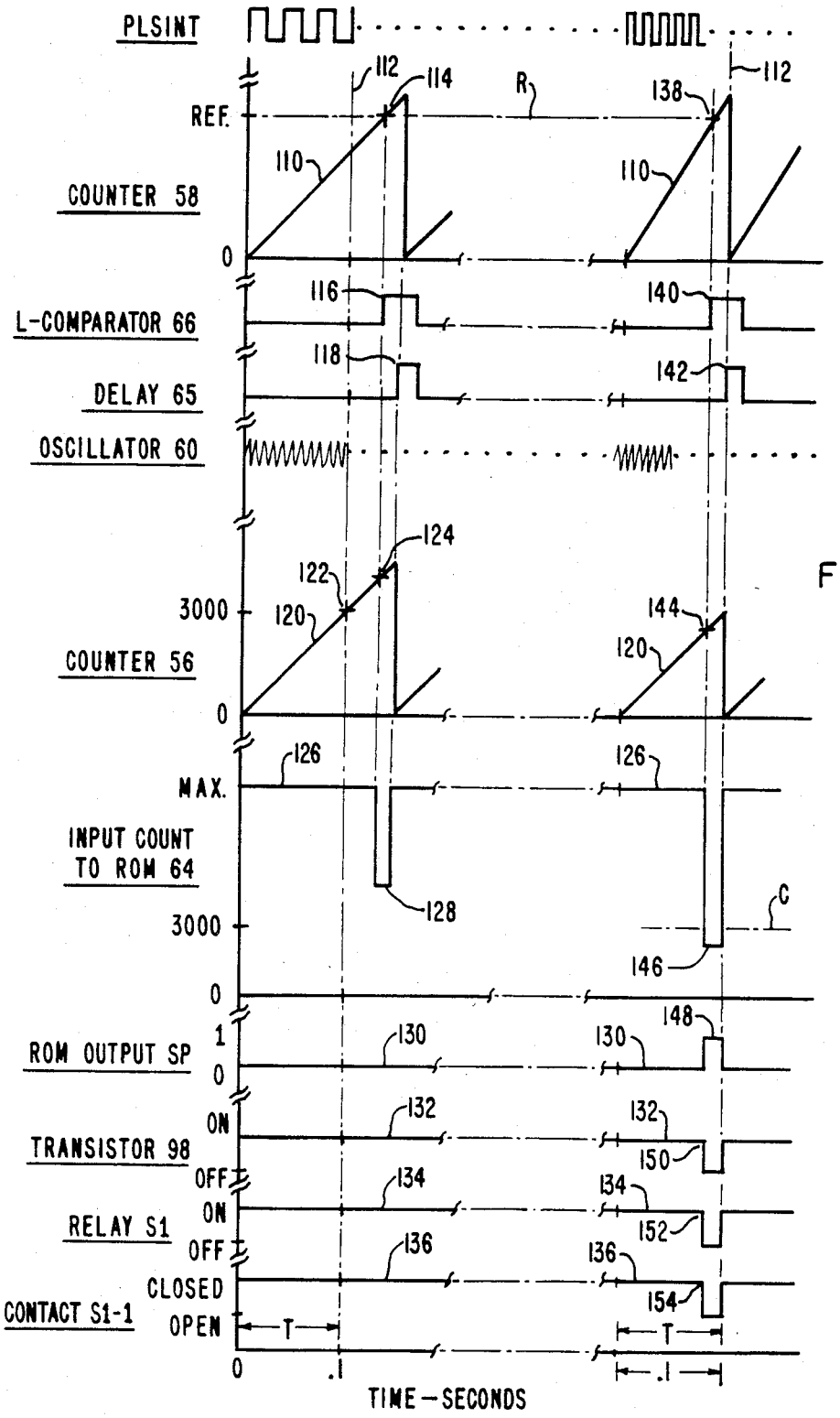
FIG. 5 is a timing diagram which sets forth the relationships between the various functions of the speed switch shown in FIG. 4.

FIG. 4 is a detailed schematic diagram of speed switch 52 and relay S1 shown in FIG. 1, setting forth an exemplary implementation thereof. FIG. 5, which is a timing diagram which illustrates the status of certain of the functions shown in FIG. 4, will also be referred to during the description of FIG. 4.

More specifically, the digital comparator function 66 may be provided by two comparators 66 and 66', such as two of Motorola's comparator MC14585, and the first and second counters 56 and 58 may each be implemented by Motorola's 12-bit binary counter MC14040. The four LSB's of counter 58 may be applied to the A input of comparator 66, and the next four LSB's may be applied to comparator 66'. The speed selection switch function 68 may be implemented by two four-bit thumb switches 68 and 68', such as AMP's 7824. Switches 68 and 68' have each of their switch elements connected from ground to the B inputs of comparators 66 and 66', respectively. The B inputs are also each connected to a source of unidirectional potential via a resistor, with the resistors being indicated generally with reference numerals 69 and 69'. The A=B outputs of the two comparators 66 and 66' are applied to the inputs of a dual input AND gate 80, and the output of AND gate 80 provides signal L after being passed through a diode 82. Signal L is applied to reset means 65, such as a delay circuit. The delay circuit, for example, may include RC circuit 84 and a logic gate 86. The logic gate 86 has its input connected to be responsive to the RC circuit 84, and its output changes from a logic zero to a logic one when the output of the RC circuit 84 reaches a predetermined magnitude.

Oscillator 60 may be provided by a four-pin chip. The latch function 62 may be provided by two 8-bit latches MM54HC534, referenced 62 and 62'. The eight LSB's of counter 56 are applied to latch 62, and the four MSB's are applied to latch 62'. The three MSB's of counter 56 are AND'ed via AND gates 88 and 90 and they will also provide a true signal L via a diode 92 to reset counters 56 and 58 in the event counter 56 is allowed to reach the end of its count.

The outputs of latches 62 and 62' are applied to a ROM 64 via address means 65. Address means 65, for example, may include a 15/5 voltage level interface function. The interface function may include two of Sprague's 8-bit voltage level interfaces ULN2081A, referenced 94 and 96. The outputs of latches 62 and 62' are applied to the inputs of interfaces 94 and 96 via resistors, indicated generally at 95 and 95', and the outputs of interfaces 94 and 96 are applied to the address inputs of ROM 64. The ROM address inputs are also connected to a source of unidirectional potential via suitable resistors, indicated generally at 99 and 99', in order to hold the ROM address inputs high when the ROM is not being addressed by a latched count, i.e., when the latch signal L is not transferring the latch input to the latch output.

The relay S1 may include a PNP junction transistor 98 and an electromechanical relay having a coil 100 and n.o. contacts S1-1. One end of coil 100 is connected directly to a source of unidirectional potential, and its other end is connected to another source of unidirectional potential via serially-connected resistors 102 and 104. The emitter of transistor 98 is connected to the junction 106 between resistors 102 and 104, its collector is connected to ground, and its base is connected to receive signal SP from ROM 64.

It will first be assumed that the car speed is below the speed setting of the speed switch 52. This situation is set forth in the left-hand vertical column of the timing diagrams shown in FIG. 5. The digital count of counter 58 starts at zero when reset, and it increases, as indicated generally by line 110. Count 110 continues past the time T indicated by broken line 112, before comparator 66 detects equality between the count of the distance pulses PLSINT and the reference count R, indicating the car speed is below the reference speed setting. The count 110 reaches the reference count R at point 114, the output of comparator 66 switches from logic zero to logic one at 116, and a short time later, the output of delay 65 switches from a logic zero to a logic one at 118.

Counter 56 counts the frequency F, starting from zero when reset, indicated by line 120, passing count C (decimal 3000) at point 122. The count at point 124 is latched by signal L, and the input count to ROM 64 drops from the maximum value indicated at 126 to the latched count, indicated at 128. The latched count has a magnitude exceeding decimal 3000, and thus the ROM output SP stays at the logic zero level, indicated at 130. Transistor 98 remains conductive, indicated by line 132, coil 100 of relay S1 remains energized, indicated by line 134, and n.o. contact S1-1 remains closed, indicated by line 136. Thus, if elevator car 12 passes hatch switch 72 on the way to the lower terminal floor 15, for example, the opening of its electrical contact H1 will have no affect on relay ETS shown in FIG. 3, i.e., relay ETS will remain in its energized state via closed contact S1-1. When the output of delay 65 goes to a logic one at 118, counters 56 and 58 are reset to zero, to start the next check of the car speed. Thus, the car speed is checked every tenth of a second, in the disclosed implementation.

The right-hand vertical column of the timing diagram illustrates the situation where the car speed is above the reference speed setting of the speed switch 52. The count 110 of counter 58 reaches the reference count R at point 138, before reaching the end of the timing interval T, indicating the car speed exceeds the speed setting of the speed switch. The output of comparator 66 changes from logic zero to logic one at point 140, and a short time later, the output of delay 65 changes from a logic zero to a logic one at point 142, to reset the counters.

The binary count of counter 56 increases as indicated generally by line 120, and it is latched at point 144 before reaching the binary equivalent of decimal 3000. Thus, the input count to ROM 64 changes from its maximum value, indicated at 126, to a count value indicated at 146 which is less than count C. Thus, the output SP of ROM 64 changes from zero, indicated by line 130, to a logic one at point 148. Transistor 98 turns off at 150, relay S1 drops out at 152 and contact S1-1 opens at 154. If the car 12 is not in a terminal slow-down zone, the associated hatch switch will be closed and thus the fact that contact S1-1 is open has no affect on the circuit shown in FIG. 3. Should the car 12, however, be above the speed setting when its associated hatch switch H1, or H3, opens its associated contact, contact S1-1 will open and drop relay ETS during the first time interval T following the opening of the hatch switch contact, to initiate the ETS function.

In summary, there has been disclosed a new and improved elevator system which utilizes distance pulses PLSINT for both the SLDN and ETS functions, and a notched blade for the TDS function. There has also been disclosed a new and improved solid state speed switch, and an ETS function utilizing the speed switch, which has a resolution of less than 1 FPM, and which may be quickly and manually set to the desired speed point.

We claim as our invention:

1. A speed switch for determining the speed of an elevator car relative to a predetermined speed V, comprising:

an oscillator having a predetermined fixed frequency F, a first counter disposed to provide a first count responsive to F, a latch for latching the first count in reponse to a latch signal L, a memory, means for addressing said memory with the latched first count, said memory being programmed to output a first signal when addressed by a count value which is below a predetermined value C, and to otherwise output a second signal, means providing distance pulses at a rate of P pulses per inch of movement of the elevator car, a second counter disposed to provide a second count responsive to said distance pulses, reference means for providing a reference count R which is a function of V, P and the time T for the first counter to count to C, comparator means for providing a latch signal L for said latch each time the second count and the reference count R have a predetermined relationship, and reset means responsive to each latch signal L for resetting said first and second counters, whereby said memory outputs the second signal when the second count reaches the predetermined relationship with the count R in the time T or more, indicating the car speed is V or less, and the first signal in a time less than T, indicating the car speed is greater than V.

2. The speed switch of claim 1 wherein the predetermined relationship between the second count and the count R which causes the comparator means to provide the latch signal L is equality.

3. The speed switch of claim 1 wherein the value of count R is selected according to the relationship R=VPT.

4. The speed switch of claim 1 wherein the predetermined value C is fixed and the reference means is adjustable, with V being selected by adjusting the reference means.

5. The speed switch of claim 1 wherein the means which provides the distance pulses includes a pulse wheel driven in synchronism with movement of the elevator car.

6. The speed switch of claim 1 wherein the means for addressing the memory with the latched first count includes means for addressing the memory with a count greater than C when the latch is not latched by the latch signal L.

7. The speed switch of claim 1 wherein the memory is a non-volatile read-only memory.

8. The speed switch of claim 1 wherein the reference means includes a thumb DIP switch.

9. The speed switch of claim 1 including a solid state switching device having first and second states responsive to the first and second signals, respectively, of the memory, and a relay having first and second states responsive to the first and second states, respectively, of the solid state switching device.

10. A terminal stopping system for initiating the stopping of an elevator car in a terminal zone adjacent to each terminal floor of a building in response to the car speed exceeding a predetermined value V at a predetermined distance S from a terminal floor, comprising:

an elevator car mounted for guided movement in a building having upper and lower terminal floors, hatch switches disposed to establish the predetermined distances S adjacent to each terminal floor, means for actuating each hatch switch associated with a terminal floor as the elevator car approaches a terminal floor, a speed switch for determining the speed of the elevator car relative to a predetermined value V, and a terminal stopping relay responsive to said hatch switches and said speed switch, said terminal stopping relay indicating an emergency stop should be initiated when it becomes deenergized, said speed switch including an oscillator having a predetermined fixed frequency F, a first counter disposed to provide a first count responsive to F, a latch for latching the first count in response to a latch signal L, a memory, means for addressing said memory with the latched first count, said memory being programmed to output a first signal when addresses by a count value which is below a predetermined value C, and to otherwise output a second signal, means providing distance pulses at a rate of P pulses per inch of movement of the elevator car, a second counter disposed to provide a second count responsive to said distance pulses, reference means for providing a reference count R which is a function of V, P and the time T for the first counter to count to C, comparator means for providing a latch signal L for said latch each time the second count and the reference count R have a predetermined relationship, reset means responsive to each latch signal for resetting said first and second counters, and a speed indication relay having electrical contacts, said speed indication relay having first and second states responsive to the first and second signals, respectively, of said memory, said terminal stopping relay being energized by a circuit which includes electrical contacts of said speed indication relay and said hatch switches arranged such that the terminal stopping relay will become deenergized when a hatch switch is actuated while the speed indication relay is in its first state.

11. The terminal stopping system of claim 10 including a plurality of hatch switches adjacent each terminal floor at predetermined different distances from the floor associated with different speeds, each arranged to be actuated by the actuating means, and a speed switch for each of the different speeds, wherein the circuit which energizes the terminal stopping relay includes electrical contacts from each speed switch and associated hatch switches, such that the terminal stopping relay will become deenergized when any hatch switch is actuated while its associated speed indicator relay is in its first state.

* * * * *